US006588887B2

(12) United States Patent
Ogawa

(10) Patent No.: US 6,588,887 B2
(45) Date of Patent: Jul. 8, 2003

(54) LIQUID DISCHARGE HEAD AND METHOD FOR LIQUID DISCHARGE HEAD

(75) Inventor: Masahiko Ogawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/940,701

(22) Filed: Aug. 29, 2001

(65) Prior Publication Data

US 2002/0057311 A1 May 16, 2002

(30) Foreign Application Priority Data

Sep. 1, 2000 (JP) ..... 2000-265194

(51) Int. Cl.[7] ..... B41J 2/05
(52) U.S. Cl. ..... 347/61; 347/65; 347/67
(58) Field of Search ..... 347/63–65, 67, 347/61, 44, 46, 47

(56) References Cited

U.S. PATENT DOCUMENTS 5,206,659 A 4/1993 Sakurai et al. ..... 347/62
5,412,413 A * 5/1995 Sekiya et al. ..... 347/46
5,417,897 A * 5/1995 Asakawa et al. ..... 347/47
5,754,202 A 5/1998 Sekiya et al. ..... 347/63

FOREIGN PATENT DOCUMENTS

JP 2-155652 * 6/1990 ..... 347/65
JP 4-16355 * 1/1992 ..... 347/65

* cited by examiner

*Primary Examiner*—Raquel Yvette Gordon
*Assistant Examiner*—Juanita Stephens
(74) *Attorney, Agent, or Firm*—Fitzpatrick, Cella, Harper & Scinto

(57) ABSTRACT

A liquid discharge head comprises discharge energy generating devices each generating energy to be utilized for discharging liquid as drops, and discharge ports arranged to face the discharge energy generating devices, respectively. For this head, the area of each discharge port is smaller than the area of each discharge energy generating device, and each of the discharge ports is arranged in the liquid. With the structure thus arranged, this liquid discharge head is made capable of discharging finer liquid droplets even at longer intervals of discharges, and also, capable of increasing the discharge speed of liquid droplets, thus making the repetition of discharge frequency extremely high, while meeting the demand that increases more for the arrangements of multiple nozzle, higher speed, and finer liquid droplet for the liquid discharge head.

18 Claims, 11 Drawing Sheets

LIQUID DISCHARGE HEAD AND METHOD FOR LIQUID DISCHARGE HEAD

BACKGROUND OF THE INVENTION

1. Field of the Invention

The present invention relates to a liquid discharge head (usually, called an ink jet recording head) that performs the recording or printing of characters, marks, images, or the like by discharging a functional liquid, such as ink, processing liquid for fixing ink, among some others, to a medium that bears recorded images, including paper, plastic sheet, cloths, and some others. The invention also relates to a liquid discharge apparatus that uses such liquid discharge head, and to a method for manufacturing the liquid discharge head as well.

2. Related Background Art

As a liquid discharge apparatus, there is the liquid discharge apparatus that records images by use of the liquid discharge head that discharges ink by utilization of thermal energy provided by heat generating element.

Conventionally, as a liquid discharge head of the kind, there has been the liquid discharge head which is structured by mounting a plate 7 having thereon an ink flow path 4 and ink discharge port 16 on the circumference of a base plate 8 having thereon a heat generating element 3 for bubbling use installed for discharging ink if the portion surrounding the ink discharge port is observed in an enlargement as shown in FIG. 13, for example.

For the liquid discharge head of the kind, various printing capabilities, such as higher image quality, higher resolution, and higher speed, are more in demand increasingly, among some others, necessitating the further provision of multiple nozzle arrangement, and finer liquid droplets as well.

However, with the aforesaid conventional structure as shown in FIG. 13, there are the problems to be encountered as given below.

For the conventional liquid discharge head as shown in FIG. 13, the area of the heat generating element for bubbling use is made smaller to make the bubbling energy smaller accordingly for obtaining finer liquid droplets to attain a higher resolution, while making the area of discharge port smaller to obtain a desired amount of discharge at a desired discharge speed. However, if the discharge port is made smaller, the viscosity of ink tends to become higher on the interfacial portion of the discharge port between ink and the air outside if the discharge interval is caused to be longer for that one particular discharge port, although there is no problem as far as discharges are made continuously all the time. If this condition takes place, discharge becomes impossible eventually, and there is a problem of disabled discharges. Also, with finer liquid droplets, a larger amount of liquid should be discharged at a higher speed to compensate for the smallness of each liquid droplet, and the air outside is drawn at the interfacial portion between ink and the air outside on the discharge port at the time of debubbling. As a result, it takes a long time to stabilize the interfacial portion thereof. This makes it difficult to repeat an extremely high frequency of discharges.

SUMMARY OF THE INVENTION

The present invention is designed under such circumstances as described above. It is an object of the invention to provide a liquid discharge head capable of discharging finer liquid droplets even at longer intervals of discharges, and also, capable of increasing the discharge speed of liquid droplets, thus making the repetition of discharge frequency extremely high, while meeting the demand that increases more for the arrangements of multiple nozzle, higher speed, and finer liquid droplets for the liquid discharge head. It is also an object of the invention to provide a liquid discharge apparatus that uses such head, and a method for manufacturing the liquid discharge head as well.

In order to achieve the above objects, the liquid discharge head of the present invention is structured as shown in the paragraphs (1) to (11); the liquid discharge apparatus as in the paragraph (12); and the method for manufacturing the liquid discharge head as in the paragraphs (13) to (22) given below.

(1) A liquid discharge head comprises a discharge energy generating device for generating energy to be utilized for discharging liquid as drops, and a discharge port arranged to face the discharge energy generating device. For this head, the area of the discharge port is smaller than the area of the discharge energy generating device, and the discharge port is arranged in the liquid.

(2) For the liquid discharge head referred to in the preceding paragraph (1), the opening portion, which holds an interface for liquid and the air outside to be in contact, is provided to face the discharge port, and the area of the opening portion is larger than the area of the discharge port.

(3) For the liquid discharge head referred to in the preceding paragraph (2), one opening portion is arranged for a plurality of discharge ports.

(4) For the liquid discharge head referred to in the paragraph (1), the distance from the front edge of the discharge port to the interface for liquid and the air outside to be in contact is within a range of 2 $\mu$m to 20 $\mu$m.

(5) For the liquid discharge head referred to in the paragraph (1), the liquid flow path is arranged corresponding to the discharge energy generating device for supplying liquid onto the discharge energy generating device.

(6) For the liquid discharge head referred to in the paragraph (1), the discharge port formation wall surrounds the space from the surface of the discharge energy generating device to the discharge port.

(7) For the liquid discharge head referred to in the preceding paragraph (6), the liquid flow path is arranged corresponding to the discharge energy generating device for supplying liquid onto the discharge energy generating device.

(8) For the liquid discharge head referred to in the preceding paragraph (7), the opening portion, which holds the interface for liquid and the air outside to be in contact, is arranged in a position facing the discharge port.

(9) For the liquid discharge head referred to in the preceding paragraph (8), the area of the opening portion is larger than the area surrounded by the edge portion of the outer wall of the discharge port formation wall on the discharge port side.

(10) For the liquid discharge head referred to in the paragraph (7), the height of the discharge port formation wall and the height of the liquid flow path wall for forming the liquid flow path are the same.

(11) For the liquid discharge head referred to in the paragraph (1), the liquid discharge head discharges liquid as drops by creating film boiling in liquid by thermal energy generated by the discharge energy generating device.

(12) A liquid discharge apparatus, which mounts thereon a liquid discharge head referred to in the paragraph (1) for discharging liquid as drops from the liquid discharge head for the adhesion thereof to a recording medium, comprises carrying means for conveying the recording medium.

(13) A method for manufacturing a liquid discharge head, which is provided with a discharge energy generating device for generating energy to be utilized for discharging liquid as drops; a discharge port arranged in the liquid to face the discharge energy generating device; a liquid flow path arranged corresponding to the discharge energy generating device for supplying liquid onto the discharge energy generating device; a discharge port formation wall surrounding the space from the surface of the energy generating device to the discharge port; and a liquid flow path wall for forming the liquid flow path, the area of the discharge port being smaller than the area of the discharge energy generating device facing the discharge port, comprises the step of forming the discharge port formation wall and the liquid flow path wall by semiconductor manufacturing process altogether on the base plate having the discharge energy generating device arranged therefor.

(14) For the method for manufacturing a liquid discharge head referred to in the paragraph (13), the semiconductor manufacturing process comprises the steps of preparing a base plate having the discharge energy generating device arranged therefor; forming an etching stop layer in a position facing the lower part of the space from the surface of the discharge energy generating device on the base plate to the discharge port; laminating film becoming material of the discharge port formation wall or the liquid flow path wall on the base plate and the etching stop layer; forming an etching mask layer in a position on the film facing the discharge port formation wall or the liquid flow path wall; forming the discharge port formation wall and the liquid flow path wall altogether by etching the film; and removing the etching stop layer and the etching mask layer.

(15) For the method for manufacturing a liquid discharge head referred to in the paragraph (13), the discharge port formation wall and the liquid flow path wall are formed by silicon nitride, silicon oxide, or silicon carbide.

(16) For the method for manufacturing a liquid discharge head referred to in the paragraph (13), the discharge port formation wall and the liquid flow path wall are formed by photosensitive resin.

(17) For the method for manufacturing a liquid discharge head referred to in the preceding paragraph (16), the photosensitive resin is a thin film formed by spin coating method on a base plate having the discharge energy generating device mounted thereon.

(18) For the method for manufacturing a liquid discharge head referred to in the paragraph (16), photosensitive resin film is adhesively bonded in the form of film to form the liquid flow path on the discharge port formation wall and the liquid flow path wall.

(19) A method for manufacturing a liquid discharge head, whack is provided with a discharge energy generating device for generating energy to be utilized for discharging liquid as drops; a discharge port arranged in the liquid to face the discharge energy generating device; a liquid flow path arranged corresponding to the discharge energy generating device for supplying liquid onto the discharge energy generating device; an opening portion positioned to face the discharge port and hold an interface for liquid and the air outside to be in contact; a discharge port formation wall surrounding the space from the surface of the energy generating device to the discharge port; a liquid flow path wall for forming the liquid flow path; and an opening portion forming member for forming the opening portion, the area of the discharge port being smaller than the area of the discharge energy generating device facing the discharge port, and the area of the opening portion being larger than the area surrounded by the edge portion of the outer wall on the discharge port side of the discharge port formation wall for forming the discharge port confronted by the opening portion, comprises the step of forming the discharge port formation wall, the liquid flow path wall, and the opening portion forming member by semiconductor manufacturing process on a base plate having the discharge energy generating device arranged therefor.

(20) For the method for manufacturing a liquid discharge head referred to in the preceding paragraph (19), the semiconductor manufacturing process comprises the steps of preparing a base plate having the discharge energy generating device arranged therefor; forming on the base plate a first film becoming the material of the lower part of the discharge port formation member or the material of the lower part of the liquid flow path wall; removing a part of the first film to form the lower part of the discharge port formation member and the lower part of the liquid flow path wall altogether; forming a second film becoming the material of the upper part of the discharge port formation member or the material of the upper part of the liquid flow path wall on the lower part of the discharge port formation member and the lower part of the liquid flow path wall so as to cover the base plate; removing a part of the second film to form the upper part of the discharge port formation material and the upper part of the liquid flow path wall altogether; forming a third film becoming the material of the opening portion forming member on the upper part of the discharge port formation member and the upper part of the liquid flow path wall so as to cover the base plate; and removing a part of the third film to form the opening portion forming member.

(21) For the method for manufacturing a liquid discharge head referred to in the paragraph (19), the opening portion forming member is formed by photosensitive resin plate.

(22) For the method for manufacturing a liquid discharge head referred to in the preceding paragraph (21), the photosensitive resin plate is a film in the form of film adhesively bonded onto the liquid flow path wall.

DETAILED DESCRIPTION OF THE PREFERRED EMBODIMENTS

Hereinafter, with reference to the accompanying drawings, the detailed description will be made of the embodiments of a liquid discharge head, and a method for manufacturing the liquid discharge head in accordance with the present invention.

(First Embodiment)

Figure 1:
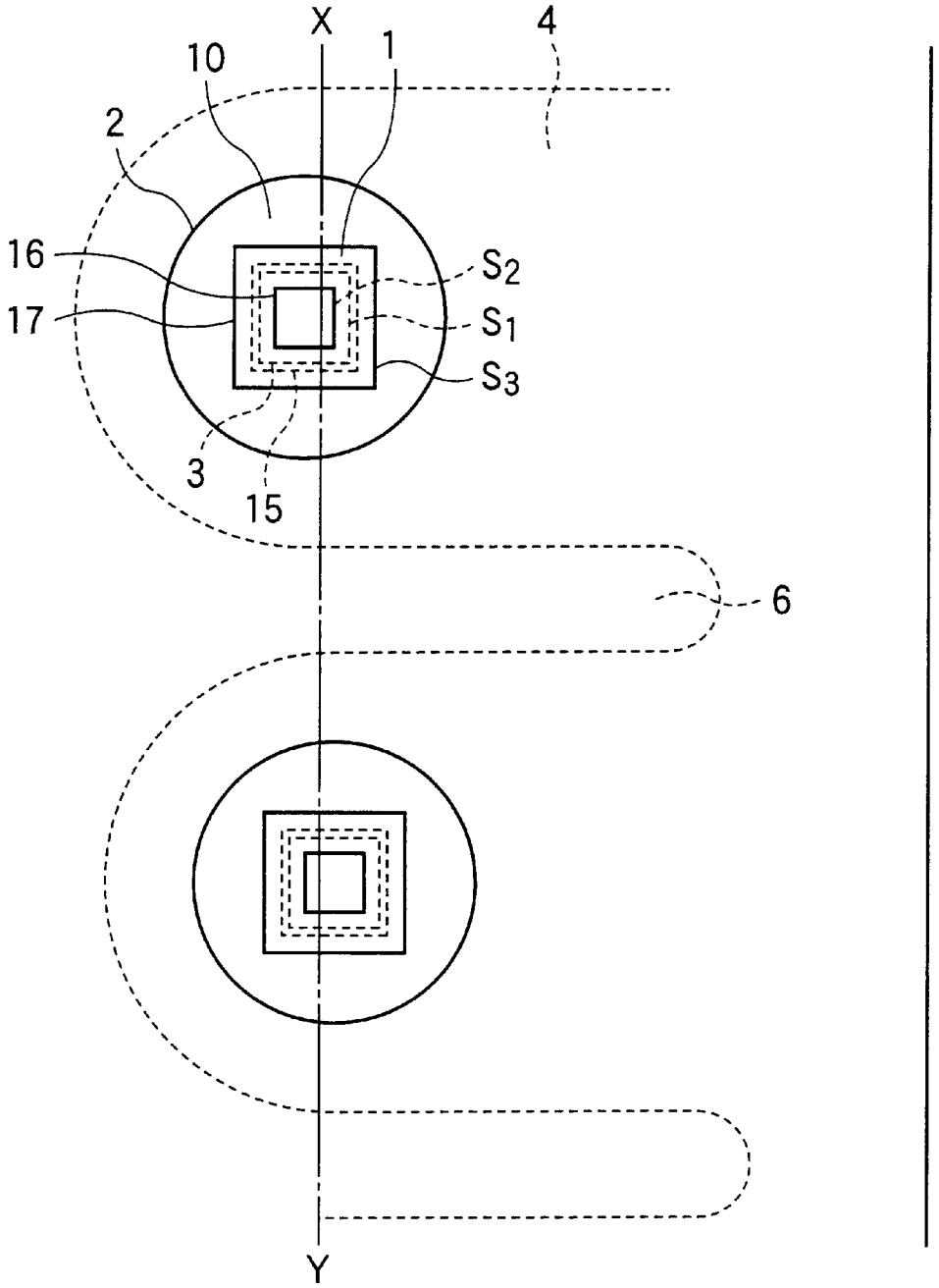
FIG. 1 is a plan view which shows the principal part of a liquid discharge head in accordance with a first embodiment of the present invention.

FIG. 1 is a plan view which shows the principal part of a "liquid discharge head" in accordance with a first embodiment. As shown in FIG. 1, the present embodiment is arranged to install a discharge port 16 having an area smaller than the area of a discharge energy generating device 3, and provided with a liquid flow path 4; a liquid flow path wall 6 to form the liquid flow path 4; and an opening portion 2 that holds or forms the interface 10 where liquid and the air outside are in contact. In the liquid flow path 4, the discharge port 16 is provided above the discharge energy generating device 3. The discharge port formation wall 1 surrounds a space (see FIG. 2) from the discharge energy generating device to the discharge port 16. Then, by the presence of this discharge port formation wall 1, the discharge port 16 is formed to be smaller than the area of the discharge energy generating device 3 indicated by dotted line. Further, there is arranged the opening portion 2 which has a larger area than the area surrounded by the edge portion of the outer wall 17 of the discharge port formation wall 1 on the discharge port 16 side. Also, adjacent liquid flow paths 4 themselves are partitioned by the liquid flow path wall 6. Here, the configuration of the discharge port 16 is square as an example. However, it may be possible to select any appropriate configuration, such as a circle or a pentagram, if only the selected configuration is optimal from the viewpoint of its characteristics, structure, or manufacture.

Figure 2:
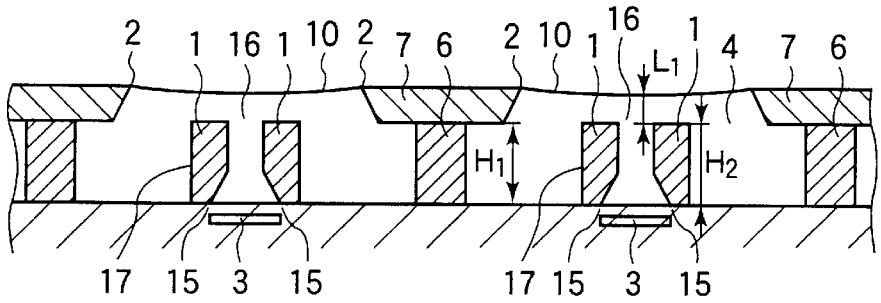
FIG. 2 is a cross-sectional view taken along line X–Y in FIG. 1.

FIG. 2 is a cross-sectional view taken along line X–Y in FIG. 1. As shown in FIG. 2, the inner wall of the discharge port formation wall 1 surrounds a space from the surface 3 of a discharge energy generating device to the discharge port 16. The lower portion of the inner wall of the discharge port formation wall 1 is tapered to be narrower in the direction toward the discharge port 16.

In this way, the discharge port formation wall 1 that surrounds the space from the surface of the discharge energy generating device 3 to the discharge port 16 is positioned above the discharge energy generating device 3 in the liquid flow path 4, and the discharge port having a smaller area than that of the discharge energy generating device 3 is formed. Also, the opening portion 2 that holds the interface 10 where liquid and the air outside are in contact is positioned outside the outer wall 17 of the discharge port formation wall 1 on the edge portion of the discharge port 16 side.

The discharge port 16 is in liquid, and it is preferable to set the distance to the interface 10 within a range of 2 $\mu$m to 20 $\mu$m. This is because if it is smaller than 2 $\mu$m, the discharge port 16 is allowed to be in contact with the interface 10, and because if it is larger than 20 $\mu$m, it becomes impossible to obtain a desired discharge speed.

Also, since the liquid flow paths 4 are partitioned by the liquid flow path walls 6, each of the liquid flow paths is formed when the plate 7 that includes opening portions 2 is bonded to the liquid flow path walls 6. As a result, unlike the conventional art, it becomes unnecessary to keep the discharge ports and discharge energy generating devices in agreement rigidly, hence making the manufacture thereof easier.

Figure 3:
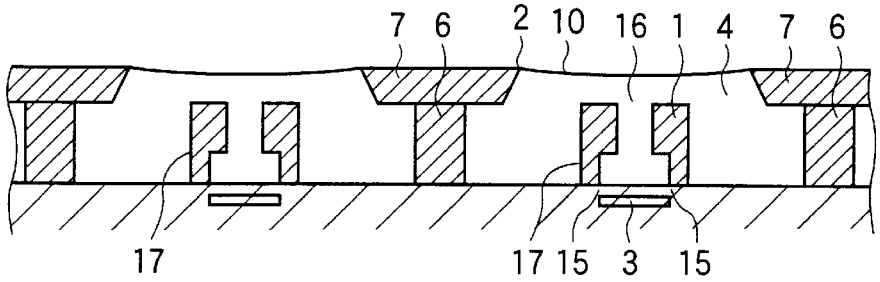
FIG. 3 is a cross-sectional view which shows the variable example represented in FIG. 2.

FIG. 3 shows the variational example of the liquid discharge head represented in FIG. 2. What differs between the representations in FIG. 2 and FIG. 3 is the configuration from the lower bottom portion 15 of the inner wall of the discharge port formation wall 1 to the discharge port 16 positioned above it. The selection of the configurations may be made in consideration of the easy with which the liquid discharge head can be manufactured actually, as well as the discharging characteristics required for such head.

Next, the description will be made of the state in which liquid is discharged when the discharge energy generating device 3 is heated for bubbling.

At first, in conjunction with FIGS. 14A to 14H, the description will be made of the case where liquid is discharged by use of a liquid discharge head in accordance with the conventional example. In this respect, for the convenience of description, liquid portion is indicated by hatching (slanting lines) in FIGS. 14A to 14H, that is, liquid is filled in the portion indicated by hatching.

Figure 14A:
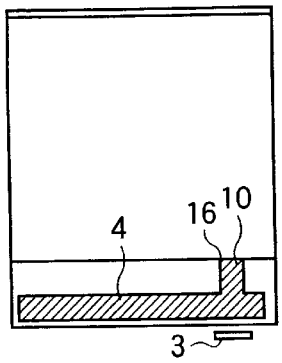
FIG.14A (PRIOR ART)
FIGS. 14A, 14B, 14C, 14D, 14E, 14F, 14G and 14H are views which illustrate the discharge process of a liquid droplet by the liquid discharge head in accordance with the conventional example.
Figure 14B:
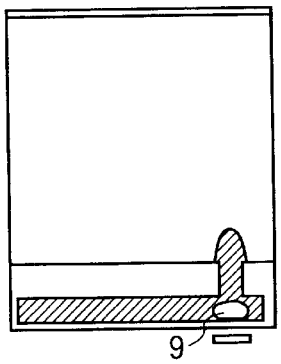
FIG.14B (PRIOR ART)
Figure 14C:
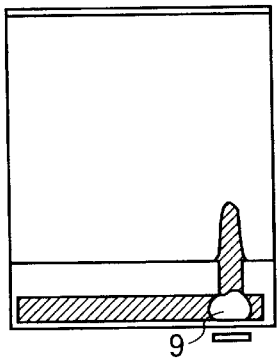
FIG.14C (PRIOR ART)
Figure 14D:
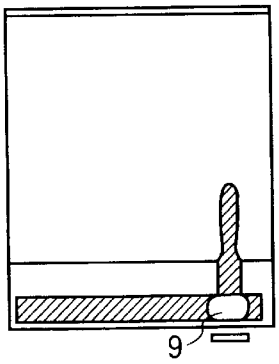
FIG.14D (PRIOR ART)
Figure 14E:
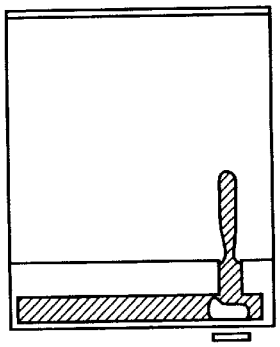
FIG.14E (PRIOR ART)
Figure 14F:
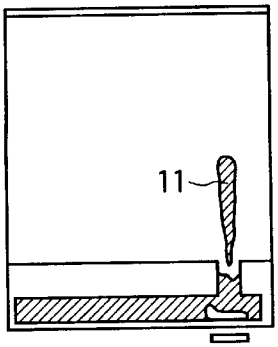
FIG.14F (PRIOR ART)
Figure 14G:
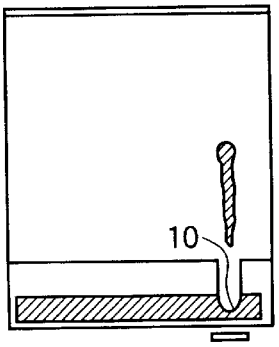
FIG.14G (PRIOR ART)
Figure 14H:
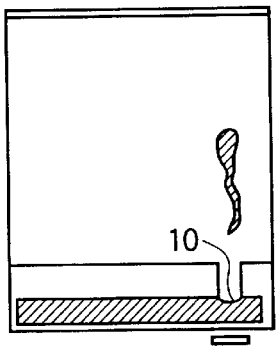
FIG.14H (PRIOR ART)

FIG. 14A shows the state where the liquid flow path 4 is filled with liquid. The interface 10 of the discharge port 16 where liquid and the air outside are in contact is stabilized. Here, when the heat generating element that serves as a discharge energy generating device 3 is energized by use of a driving circuit (not shown), this element is heated and temperature rises. Then, with the temperature of the interface with liquid on the discharge energy generating device 3 (ink liquid or the like) rising to the film boiling temperature of the liquid, film boiling occurs in the liquid to begin bubbling. FIG. 14B shows the bubbling state. After that, by the pressure exerted by bubbling, the bubbled space 9 increases as shown in FIGS. 14B and 14C to cause the liquid to move. Then, the upper portion of the discharge port 16 swells to be discharged gradually. Thus, subsequent to the bubbled space 9 having become the largest, the bubble shifts into the defoaming process as shown in FIG. 14D. The liquid which begins to be discharged advances as shown in FIGS. 14E and 14F. Then, as shown in FIG. 14F, being cut off, a liquid droplet 11 flies out, and as shown in FIG. 14G, the interface 10 is recessed at the time of debubbling. Thus, as shown in FIG. 14H, the interface 10 returns gradually to the original position of the interface 10 shown in FIG. 14A. Usually, the time required for this returning process is longer than the time required for bubbling to debubbling by approximately two to six times. In other words, the returning time varies depends on the inner diameter of the discharge port 16 that exerts the capillary force. This returning time is the cause that delays the repeated frequency of discharges.

Next, in conjunction with FIGS. 7A to 7G, the description will be made of the case where the present embodiment is executed. Here, in FIGS. 7A to 7G, the liquid portion is also indicated by hatching (slanting lines) as in the case described in conjunction with FIGS. 14A to 14H.

Figure 7A:
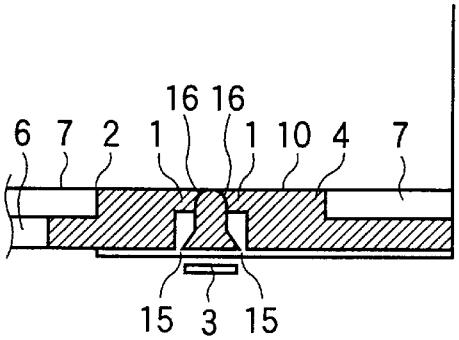
FIGS. 7A, 7B, 7C, 7D, 7E, 7F and 7G are views which illustrate the discharge process of a liquid droplet by the liquid discharge head in accordance with the first embodiment.
Figure 7B:
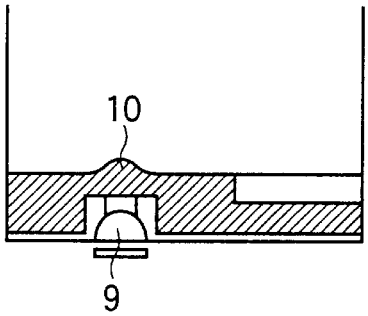
Figure 7C:
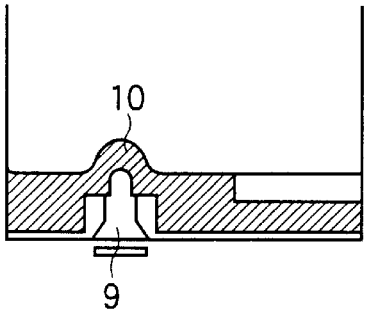
Figure 7D:
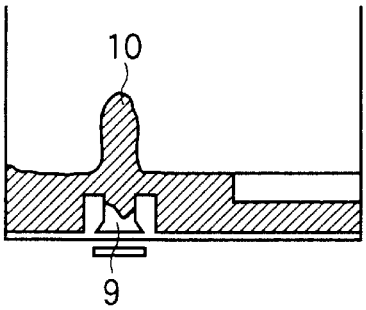
Figure 7E:
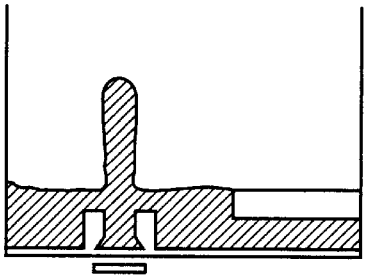
Figure 7F:
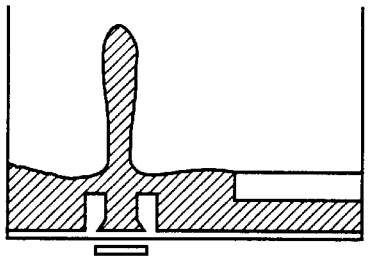
Figure 7G:
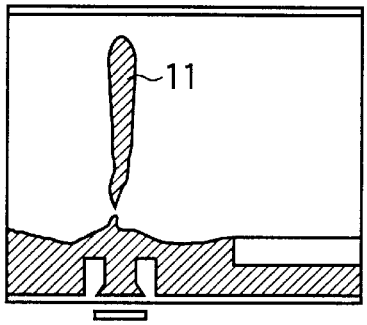

FIG. 7A shows the state where the liquid flow path 4 is filled with liquid. The interface 10 of the opening portion 2 where liquid and the air outside are in contact is stabilized. Here, when the heat generating element that serves as a discharge energy generating device 3 is energized by use of a driving circuit (not shown), this element is heated and temperature rises. Then, with the temperature of the interface with liquid on the discharge energy generating device 3 (ink liquid or the like) rising to the film boiling temperature of the liquid, film boiling occurs in the liquid to begin bubbling. FIG. 7B shows the bubbling state. After that, by the pressure exerted by bubbling, the bubbled space 9 increases as shown in FIGS. 7B and 7C to cause the liquid to move. Then, the upper portion of the discharge port 16 which is a part of the interface 10 swells to be discharged gradually. At this juncture, the liquid moves upward vigorously from the inner side of the discharge port formation wall 1 that surrounds the space from the surface of the discharge energy generating device 3 to the discharge port 16, because the area of the discharge port 16 is smaller than the area of the discharge energy generating device 3. Thus, subsequent to the bubbled space 9 having become the largest, the bubble shifts into the defoaming process as shown in FIG. 7D. The swelling liquid advances as shown in FIG. 7E and FIG. 7F. Then, as shown in FIG. 7G, being cut off, a liquid droplet 11 flies out. In other words, a small liquid droplet 11 is discharged from the large opening portion 2 at the discharging speed which is made greater.

Also, as shown in FIG. 7D and FIG. 7E, liquid is supplied from the circumference when the bubble is being defoamed. As a result, the interface 10 is quickly stabilized to make it possible to heat the discharge energy generating device 3 for bubbling immediately after the bubble has been defoamed. In this manner, the repeating frequency of discharges can be enhanced.

As described above, in accordance with the present embodiment, the area of the discharge energy generating device is made smaller than the area of the discharge port and the discharge port is arranged in the liquid. As a result, a liquid droplet is discharged in an amount of discharge corresponding to the configuration of the discharge port in the liquid above the discharge energy generating device, not in the amount of discharge corresponding to the configuration of the interface where liquid and the air outside are in contact as in the case of the conventional art. Therefore, whereas it has been necessary conventionally to make the configuration of the interface where liquid and the air outside are in contact smaller in order to make a liquid droplet finer for obtaining a higher resolution, this arrangement is no longer needed, yet it is made possible to discharge a smaller liquid droplet form an opening portion having a large configuration of the interface where liquid and the air outside are in contact. Thus, the liquid viscosity is not allowed to increase easily on the interface of the opening portion where liquid and the air outside are in contact, and even if the discharge interval should become longer for one and the same nozzle, it is possible to discharge smaller liquid droplets stably. Also, with the area of opening portion of the discharge port being smaller than the area of the discharge energy generating device, the discharge energy concentrates on the central portion of the discharge port. As a result, it becomes possible to discharge a liquid droplet at a faster discharge speed in excellent rectilinear progression. Also, unlike the conventional art, there is no possibility that the interface is pulled from the opening portion at the time of debubbling, and that the interface is not allowed to be recessed, hence making it possible to implement discharging in a desired amount at a desired speed quickly, and to provide an extremely high repeating frequency of discharges. Also, the size of the opening portion can be made larger without regard to the discharge liquid droplet. As a result, when the plate having the opening portions arranged therefor is bonded, the bonding precision is not necessarily made higher, thus facilitating the manufacturing process with a favorable increase of production yield for the cost reduction.

In this respect, for the present embodiment, it is arranged to set the area $S_1$ of the discharge energy discharging device 3, the opening area $S_2$ of the discharge port 16, the opening area $S_3$ of the opening portion 2, the height $H_1$ of the liquid flow path wall 6, the height $H_2$ of the discharge port formation wall 1, and the distance $L_1$ between the discharge port 16 and the air-liquid interface 10 at the values indicated on the Table 1 (a), respectively. With the structure thus arranged, it becomes possible to discharge a liquid droplet having the discharge amount of 2.7 ng at a discharge speed of 10 m/s. Also, as shown in the column (b) on the Table 1, the discharge amount of liquid droplet and discharge speed are 3.7 ng and 5 m/s, respectively, if the opening area $S_2$ of the discharge port 16 is set at 196 $\mu m^2$ (14 $\mu m \times 14$ $\mu m$). Also, as shown in the column (c) of the Table 1, if the opening area $S_2$ of the discharge port 16 is set at the opening area $S_1$ of the discharge energy generating device 3, only the air-liquid interface 10 is protruded, but no liquid droplet is discharged. In this way, the liquid discharge head of the present embodiment is provided with the discharge ports in the liquid, and the opening area of each discharge port 16 is made smaller than the area of each discharge energy generating device 3, hence enabling a small liquid droplet to be discharged from each of the large opening portions. Further, it is confirmed that the smaller the opening area of the discharge port 16 than the area of the discharge energy generating device 3, the smaller becomes the liquid droplet which can be discharged at faster discharge speed.

TABLE 1

| | Area $S_1$ of the discharge energy generating device | Opening area $S_2$ of the discharge port | Opening area $S_3$ of the opening portion | Height $H_1$ of the liquid flow path wall | Height $H_2$ of the discharge port formation wall | Distance $L_1$ Between the discharge port and the air-liquid interface | Discharge amount of liquid droplet | Discharge speed of liquid droplet |
|---|---|---|---|---|---|---|---|---|
| (a) | 216 $\mu m^2$ (16 $\mu m \times 16$ $\mu m$) | 100 $\mu m^2$ (10 $\mu m \times 10$ $\mu m$) | 707 $\mu m^2$ ($\phi$ 30 $\mu m$) | 12 $\mu m$ | 12 $\mu m$ | 8 $\mu m$ | 2.7 ng | 10 m/s |

TABLE 1-continued

| | Area $S_1$ of the discharge energy generating device | Opening area $S_2$ of the discharge port | Opening area $S_3$ of the opening portion | Height $H_1$ of the liquid flow path wall | Height $H_2$ of the discharge port formation wall | Distance $L_1$ Between the discharge port and the air-liquid interface | Discharge amount of liquid droplet | Discharge speed of liquid droplet |
|---|---|---|---|---|---|---|---|---|
| (b) | 216 $\mu m^2$ (16 $\mu m$ × 16 $\mu m$) | 196 $\mu m^2$ (14 $\mu m$ × 14 $\mu m$) | 707 $\mu m^2$ ($\phi$ 30 $\mu m$) | 12 $\mu m$ | 12 $\mu m$ | 8 $\mu m$ | 3.7 ng | 5 m/s |
| (c) | 216 $\mu m^2$ (16 $\mu m$ × 16 $\mu m$) | 216 $\mu m^2$ (16 $\mu m$ × 16 $\mu m$) | 707 $\mu m^2$ ($\phi$ 30 $\mu m$) | 12 $\mu m$ | 12 $\mu m$ | 8 $\mu m$ | — | — |

(Second Embodiment)

Figure 4:
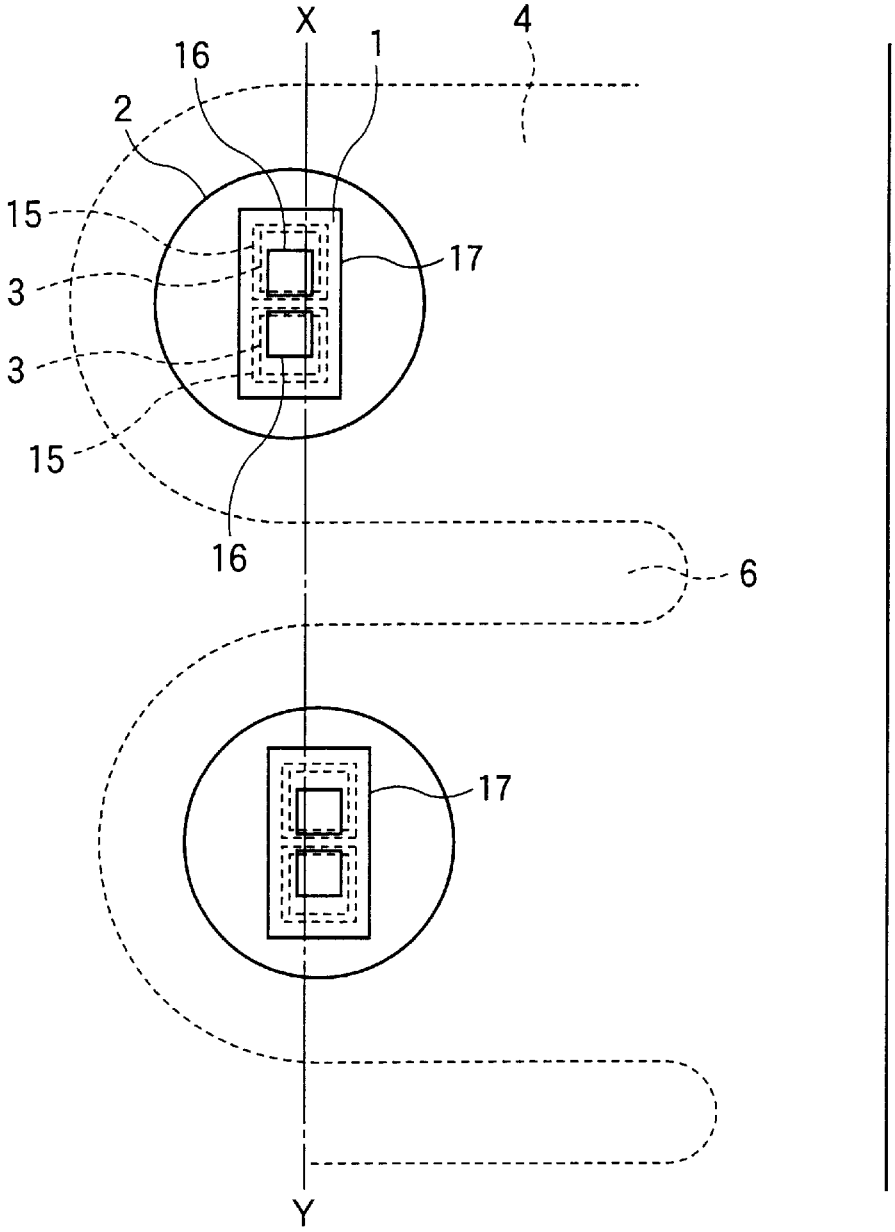
FIG. 4 is a plan view which shows the principal part of a liquid discharge head in accordance with a second embodiment.

FIG. 4 is a plan view which shows the principal part of a "liquid discharge head" in accordance with a second embodiment. As shown in FIG. 4, this is an example that provides a plurality of discharge energy generating devices 3 for one opening portion 2. In FIG. 4, plural discharge energy generating devices 3, two for the present embodiment, are arranged in the liquid flow path 4 for one opening portion 2. Then, per discharge energy generating device 3, the discharge port formation wall 1 is formed to surround the space from the surface of each discharge energy generating device 3 to each discharge port 16. The area of each discharge energy generating device 3 is made smaller than the area of each discharge port 16. Also, each of the discharge port formation walls 1 for one opening portion 2 is formed integrally, and the opening area of this opening portion 2 is larger than the area surrounded by the edge portions of the outer wall 17 of the discharge port formation walls 1 on the discharge port 16 side. Also, the adjacent liquid flow paths 4 themselves are partitioned by the liquid flow path wall 6.

Figure 5:
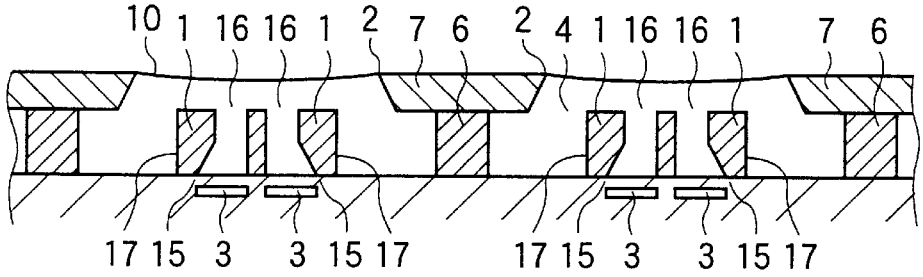
FIG. 5 is a cross-sectional view taken along line X–Y in FIG. 4.
Figure 6:
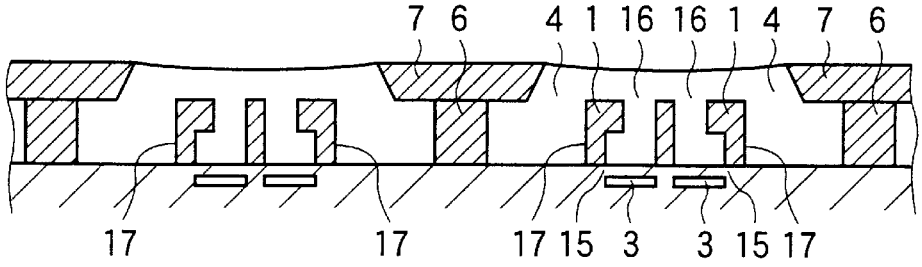
FIG. 6 is a cross-sectional view which shows the variable example represented in FIG. 5.

FIG. 5 is a cross-sectional view taken along line X–Y in FIG. 4. FIG. 6 shows the variational example thereof. As shown in FIG. 5 or FIG. 6, each wall 1 that surrounds the space to the discharge port 16 is positioned in the liquid flow path 4 above two discharge energy generating devices 3, and each of the discharge ports, having smaller area than the area of each discharge energy generating device 3, is formed, respectively. Also, the opening portion 2 is positioned outside the edge portion of the wall 1 that surrounds the space to the discharge port 16 on the discharge port 16 side. Also, the discharge port 16 is in the liquid, and the distance to the interface 10 is set within a range of 2 $\mu$m to 20 $\mu$m. This is because if it is smaller than 2 $\mu$m, the discharge port 16 is allowed to be in contact with the interface 10, and because if it is larger than 20 $\mu$m, it becomes impossible to obtain a desired discharge speed.

Also, since the adjacent liquid flow paths 4 themselves are partitioned by the liquid flow path walls 6, each of the liquid flow paths is formed when the plate 7 that includes opening portions 2 is bonded to the liquid flow path walls 6. As a result, it becomes unnecessary to keep the opening portion 2 and discharge energy generating device 3 in agreement rigidly, hence making the manufacture easier in this respect.

Also, it is possible to discharge a smaller liquid droplet by heating one of the tow discharge energy generating devices 3, and to discharge a larger liquid droplet by heating both of the two discharge energy generating devices 3.

The state in which liquid is discharged by heating the discharge energy generating device 3 is the same as the case of the first embodiment. Here, therefore, any repeated description will be omitted. In accordance with the present embodiment, it becomes possible to perform each discharge rapidly in an amount twice the amount of discharge executable in accordance with the first embodiment.

As described above, in accordance with the present embodiment, the area of the discharge energy generating device is made smaller than the area of the discharge port and the discharge port is arranged in the liquid. As a result, a liquid droplet is discharged in an amount of discharge corresponding to the configuration of the discharge port in the liquid above the discharge energy generating device, not in the amount of discharge corresponding to the configuration of the interface where liquid and the air outside are in contact as in the case of the conventional art. Therefore, whereas it has been necessary conventionally to make the configuration of the interface where liquid and the air outside are in contact smaller in order to make a liquid droplet finer for obtaining a higher resolution, this arrangement is no longer needed, yet it is made possible to discharge a smaller liquid droplet form an opening portion having a large configuration of the interface where liquid and the air outside are in contact. Thus, the liquid viscosity is not allowed to increase easily on the interface of the opening portion where liquid and the air outside are in contact, and even if the discharge interval should become longer for one and the same nozzle, it is possible to discharge smaller liquid droplets stably. Also, with the area of opening portion of the discharge port being smaller than the area of the discharge energy generating device, the discharge energy concentrates on the central portion of the discharge port. As a result, it becomes possible to discharge a liquid droplet at a faster discharge speed in excellent rectilinear progression. Further, plural liquid droplets can be discharged from one opening portion to make it possible to perform a gradation recording. Also, unlike the conventional art, there is no possibility that the interface is pulled from the opening portion at the time of debubbling, and that the interface is not allowed to be recessed, hence making it possible to implement discharging in a desired amount at a desired speed quickly, and to provide an extremely high repeating frequency of discharges. Also, the size of the opening portion can be made larger without regard to the discharge liquid droplet. As a result, when the plate having the opening portions arranged therefor is bonded, the bonding precision is not necessarily made higher, thus facilitating the manufacturing process with a favorable increase of production yield for the cost reduction.

(Third Embodiment)

A third embodiment is the example in which the liquid discharge head of the first embodiment (see FIG. 2) is manufactured by means of the semiconductor manufacturing process using silicon nitride film. FIGS. 8A to 8F represent the principal part of the liquid discharge head of the first embodiment, and illustrate a method for manufacturing the discharge port formation wall 1 that surrounds the space to the discharge port 16 and the wall 6 that surrounds the liquid flow path. Any other portions than this principal part may be manufactured by means of any appropriate method conventionally available. Here, therefore, the description thereof will be omitted.

Figure 8A:
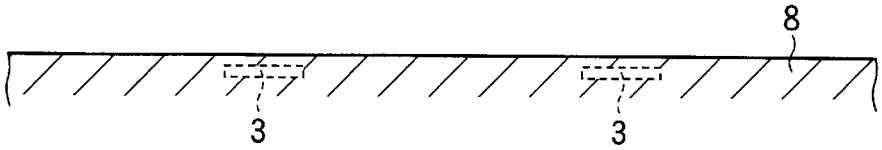
FIGS. 8A, 8B, 8C, 8D, 8E and 8F are views which illustrate a method for manufacturing a liquid discharge head in accordance with a third embodiment.
Figure 8B:
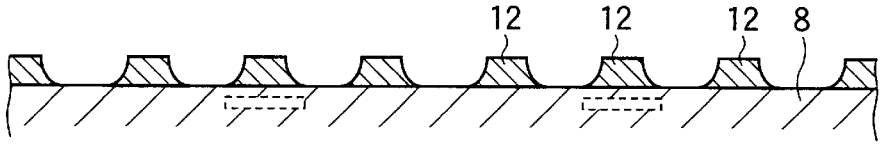
Figure 8C:
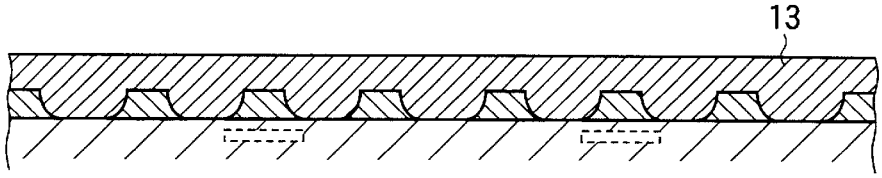
Figure 8D:
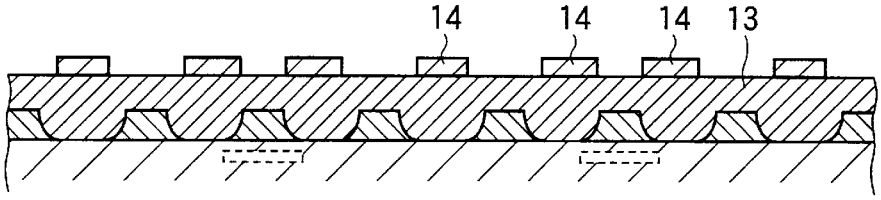
Figure 8E:
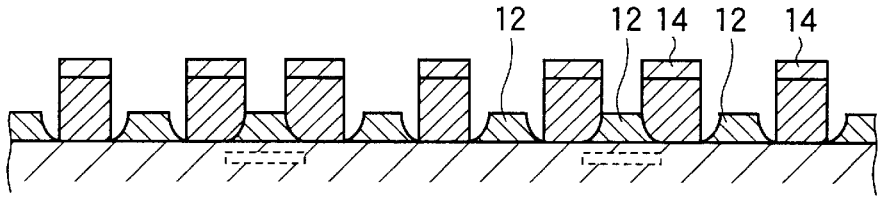
Figure 8F:
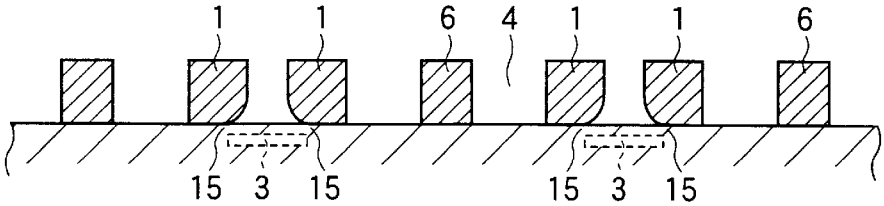

FIG. 8A shows the upper section of the base plate 8 having the discharge energy generating devices 3 installed thereon. On this base plate 8, aluminum is sputtered, patterned, and taper-etched so as to prevent the base plate 8 from being damaged when the overlaying silicon nitride film (SiN film) is etched, and the etching stop layer 12 is formed as shown in FIG. 8B in order to produce the space which is curved upward from the lower bottom side portion 15 of the inner wall of the wall 1 that surrounds the space to the discharge port 16. Then, as shown in FIG. 8C, the SiN film 13 is formed on this layer at high speed by means of plasma CVD or the like as the material which is used for the formation of wall 1 that surrounds the space to the discharge port 16, as well as the wall 6 that surrounds the liquid flow path. Then, on this film, aluminum is sputtered and etched to from the etching mask 14 as shown in FIG. 8D for providing the space for use of the liquid flow path. Thus, the SiN film 13 is etched at high speed to the etching stop layer 12 to form it as shown in FIG. 8E. Lastly, then, the etching stop layer 12 and aluminum of the etching mask layer 14 are removed to form the wall 1 that surrounds the space to the discharge port 16 and the wall 6 that surrounds the liquid flow path as shown in FIG. 8F. If the height of the wall 1 that surrounds the space to the discharge port 16 and that of the wall 6 that surrounds the liquid flow path are made the same, the manufacturing processes can be simplified. In this manner, the liquid flow path 4 can be finished by bonding the plate 7 including the opening 2 onto the wall 1 that surrounds the space to the discharge port 16 and the wall 6 that surrounds the liquid flow path. Thus, unlike the conventional art, it becomes unnecessary to keep each of the discharge ports and discharge energy generating devices to be rigidly in agreement, facilitating the manufacture in this respect, too.

Likewise, in conjunction with FIGS. 9A to 9F, the description will be made of a method for manufacturing the discharge port formation wall 1 that surrounds the space to the discharge port 16 and the liquid flow path wall 6 that forms the liquid flow path of the liquid discharge head (see FIG. 3) which is the variational example of the first embodiment.

Figure 9A:
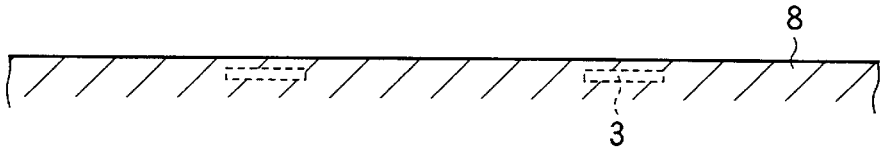
FIGS. 9A, 9B, 9C, 9D, 9E and 9F are views which illustrate the variational example of the method for manufacturing a liquid discharge head in accordance with the third embodiment.
Figure 9B:
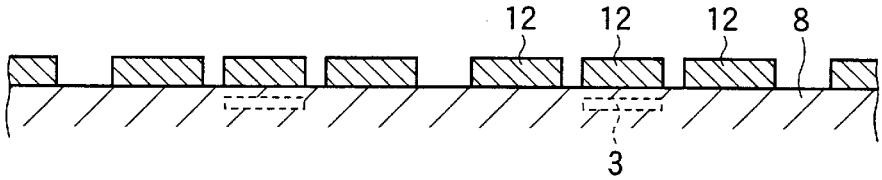
Figure 9C:
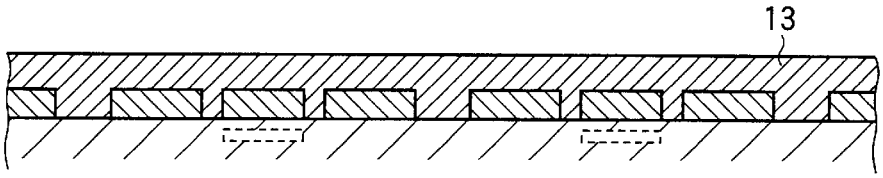
Figure 9D:
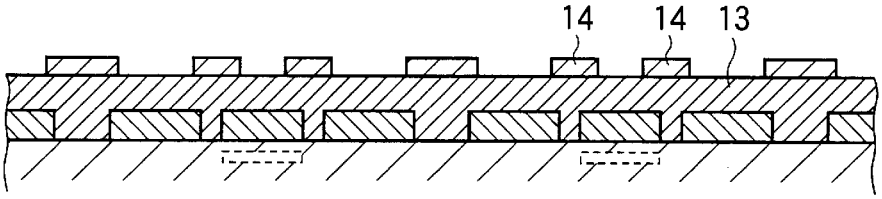
Figure 9E:
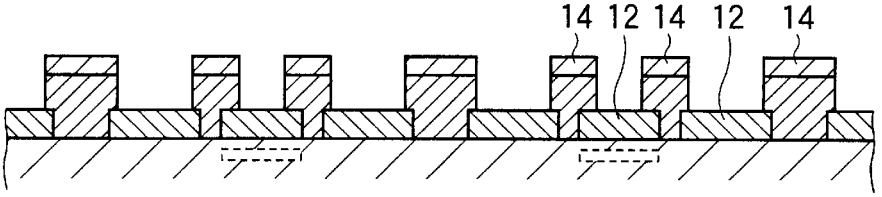
Figure 9F:
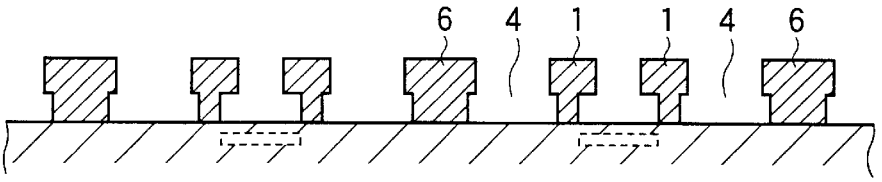

FIG. 9A shows the upper section of the base plate 8 having the discharge energy generating devices 3 installed thereon. On this base plate 8, aluminum is sputtered, and etched so as to prevent the base plate 8 from being damaged when the overlaying silicon nitride film (SiN film) is etched, and the etching stop layer 12 is formed as shown in FIG. 9B in order to make the area of the discharge port 16 smaller than the area of the discharge energy generating device 3. Then, as shown in FIG. 9C, the SiN film 13 is formed on this layer at high speed by means of plasma CVD or the like as the material which is used for the formation of wall 1 that surrounds the space to the discharge port 16, as well as the liquid flow path wall 6. Then, on this film, aluminum is sputtered and etched to from the etching mask 14 as shown in FIG. 9D for providing the space for use of the liquid flow path. Thus, the SiN film 13 is etched at high speed to the etching stop layer 12 to form it as shown in FIG. 9E. Lastly, then, the etching stop layer 12 and aluminum of the etching mask layer 14 are removed to form the discharge port formation wall 1 and the liquid flow path wall 6 as shown in FIG. 9F. If the height of the discharge port formation wall 1 and the liquid flow path wall 6 are made the same, the manufacturing processes can be simplified.

In this respect, for the present embodiment, the discharge port formation wall 1 and the liquid flow path wall 6 are formed with silicon nitride, but the formation thereof is not necessarily limited thereto. It may be possible to form them with silicon oxide or silicon carbide.

(Fourth Embodiment)

A fourth embodiment is the example in which the liquid discharge head (see FIG. 3), which is the variational example of the first embodiment, is manufactured by the semiconductor manufacturing process using photosensitive resin. FIGS. 10A to 10G and FIGS. 11H to 11J represent the principal part of the variational example of the liquid discharge head of the first embodiment shown in FIG. 3, illustrating the method for manufacturing the portion of the discharge formation wall 1 and the liquid flow path wall 6. Any other portions other than this may be manufactured in accordance with the conventional art. Here, therefore, the description thereof will be omitted.

Figure 10A:
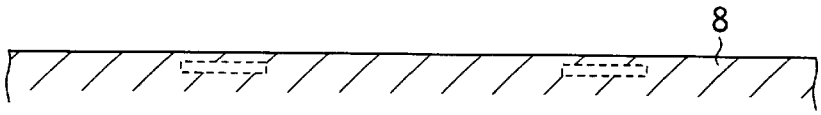
FIGS. 10A, 10B, 10C, 10D, 10E, 10F and 10G are views which illustrate a method for manufacturing a liquid discharge head in accordance with a fourth embodiment.
Figure 10B:
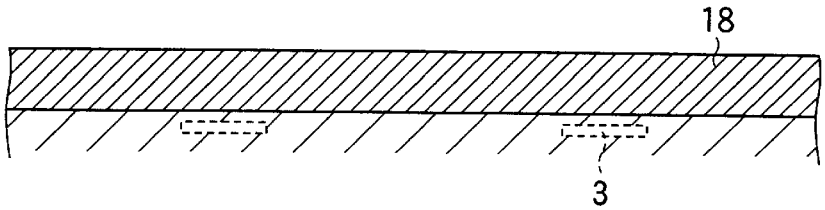
Figure 10C:
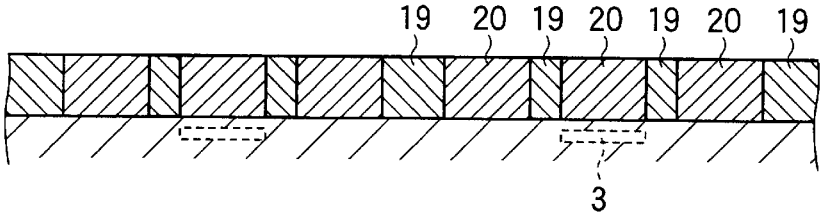
Figure 10D:
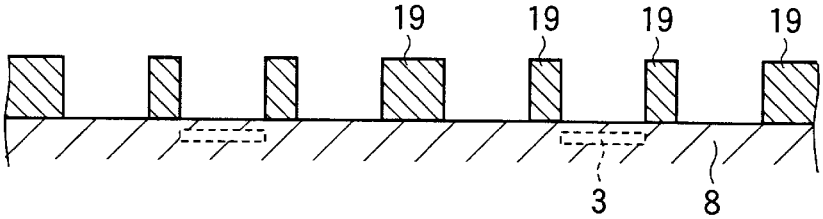
Figure 10E:
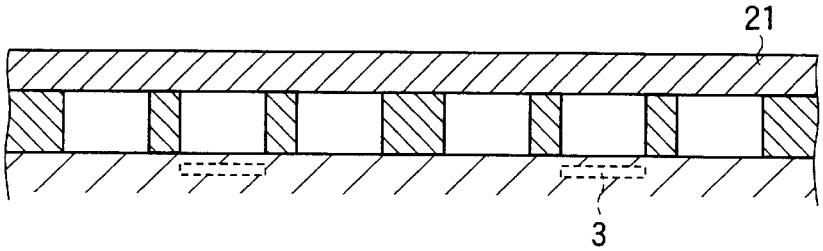
Figure 10F:
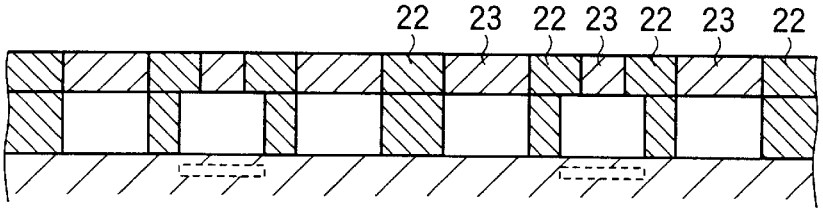
Figure 10G:
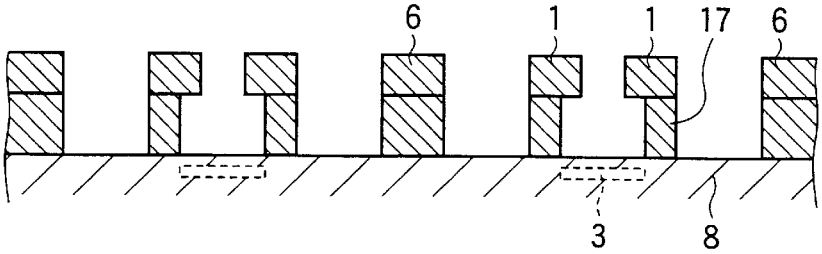

FIG. 10A shows the upper section of the base plate 8 having the discharge energy generating devices 3 installed thereon. On this base plate 8, a first photosensitive resin film of liquid negative resist type is spin-coated to form the film at 18 in FIG. 10B. In this state, the film thus formed is exposed with the application of a photomask so that the exposed portion 19 of the first photosensitive resin film remains as shown in FIG. 10C. Then, developing process is given and the non-exposed portion at 20 is removed by baking, thus forming a part of the liquid flow path wall as shown in FIG. 10D. Further, on this portion, a second photosensitive resin film of negative resist type is adhesively bonded to form the film at 21 in FIG. 10E. In this state, the film thus formed is exposed with the application of a photomask so that the exposed portion 22 of the second photosensitive resin film remains as shown in FIG. 10F. Then, developing process is given and the non-exposed portion at 23 is removed by baking, thus forming the discharge port formation walls 1 and the liquid flow path wall 6 as shown in FIG. 10G. If the height of the discharge port formation wall 1 and the liquid flow path wall 6 are made the same in this manner, the manufacturing processes can be simplified. Then, the liquid flow path can be finished only by bonding the plate 7 including the opening 2 onto the discharge port formation wall 1 and the liquid flow path wall 6, and, unlike the conventional art, it becomes unnecessary to keep each of the discharge ports and discharge energy generating devices to be rigidly in agreement so as to make the manufacture easier in this respect, too.

Figure 11H:
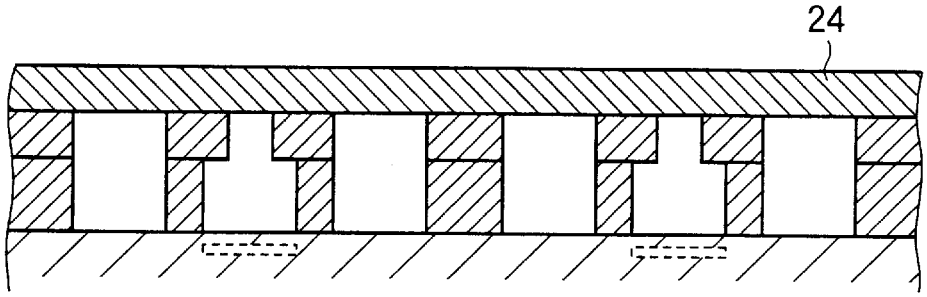
FIGS. 11H, 11I and 11J are views which illustrate the method for manufacturing a liquid discharge head in accordance with the fourth embodiment in continuation of FIGS. 10A to 10G.
Figure 11I:
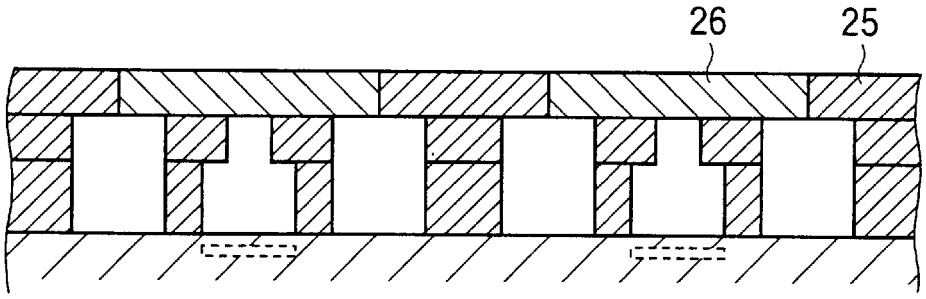
Figure 11J:
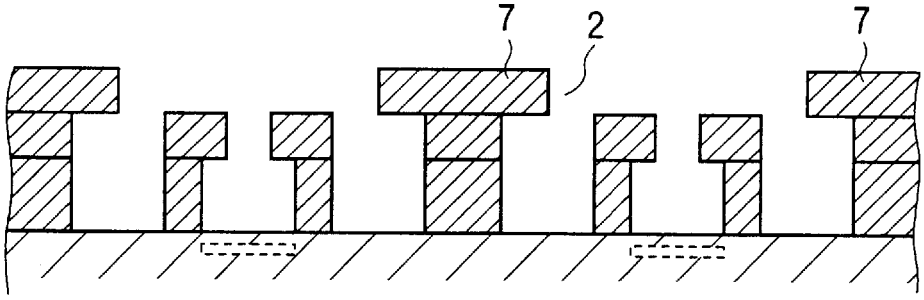

Further, on the structure arranged as shown in FIG. 10G, a third photosensitive resin film of negative resist type is adhesively bonded to form the film at 24 in FIG. 11H. In this state, the film is exposed with the application of a photomask so that the exposed portion 25 of the third photosensitive resin film remains as shown in FIG. 11I. Then, developing process is given, and the non-exposed portion 26 is removed by baking to form the plate 7 including the opening 2 as shown in FIG. 11J. Thus, the manufacture is possible by means of the semiconductor manufacturing process with extremely high precision at lower costs.

(Other Embodiment)

Figure 12:
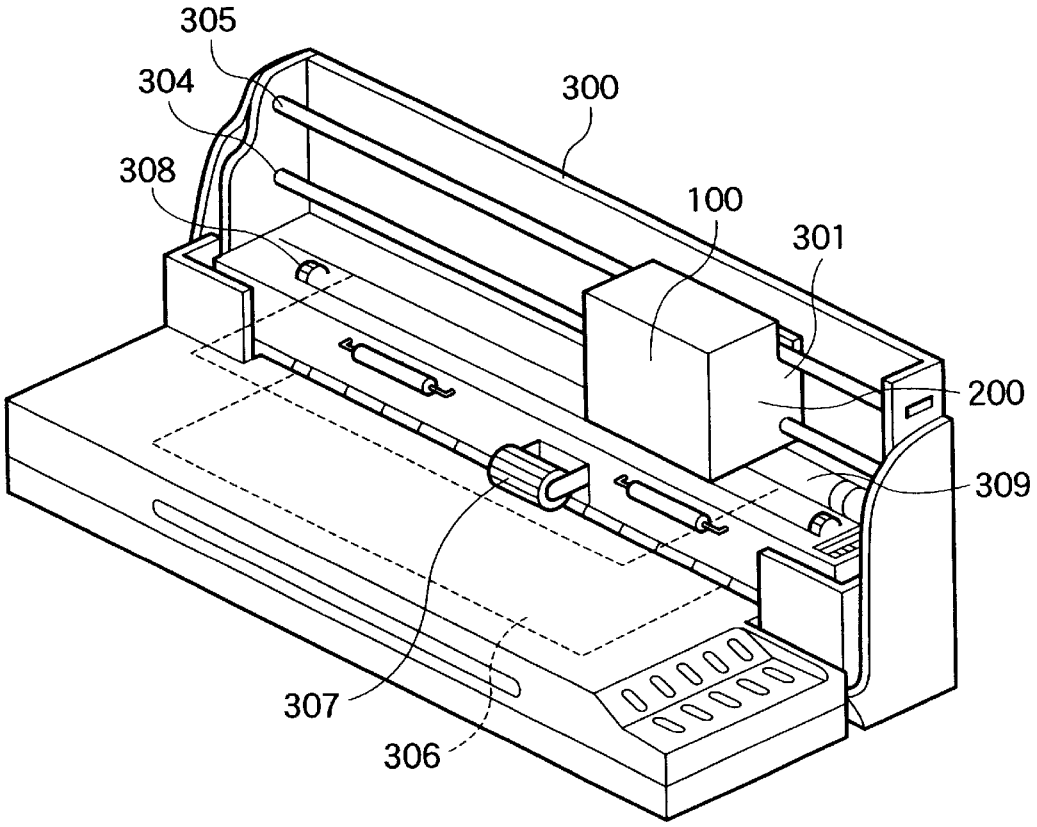
FIG. 12 is a view which schematically shows a liquid discharge apparatus in accordance with the present invention.
Figure 13:
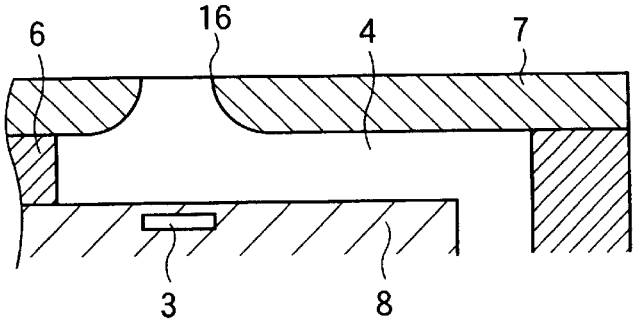
FIG.13 (PRIOR ART)
FIG. 13 is a cross-sectional view which shows the principal part of a liquid discharge head in accordance with the conventional example.

FIG. 12 is a perspective view which shows a liquid discharge apparatus having mounted thereon a head cartridge 200 provided with the liquid discharge head 100 as shown in FIG. 1 and FIG. 2. The liquid discharge apparatus shown in FIG. 12 is provided with the lead screw 304 and the guide shaft 305 arranged in parallel to each other in a housing. For the lead screw 304 and the guide shaft 305, a carriage 301 is installed movably in the direction parallel to the lead screw 304 and the guide shaft 305. The carriage 301 moves in parallel to the lead screw 304 when it is rotated by use of a carriage motor (not shown).

On the carriage 301, the head cartridge 200 is mounted with the liquid discharge head 100 as shown in FIG. 1 and FIG. 2. In the vicinity of the plane of movement locus of the discharge surface of the liquid discharge head 100, a paper pressure plate 309 is arranged.

Also, the liquid discharge apparatus is provided with the sheet feed roller 307 that conveys a recording sheet 306 serving as a recording medium toward the recording area of the liquid discharge head 100, and the sheet expelling roller 308 which expels the recording sheet 306 after the execution of recording by the liquid discharge head 100. The sheet feed roller 307 and the sheet expelling roller 308 are rotated by use of a motor (not shown). The recording medium conveyance mechanism, which conveys the recording sheet 306 for receiving liquid discharged from the liquid discharge head 100 on the head cartridge 200, is structured by such motor, the sheet feed roller 307, the sheet expelling roller 308, and others. Then, the carriage 301 reciprocates in the direction intersecting with the conveying direction of the recording sheet 306 by the recording medium conveyance mechanism thus structured.

When ink discharged from the liquid discharge head 100 adheres to the recording sheet 306 which faces the discharge port surface of the liquid discharge head 100, the recorded images are formed on the surface of the recording sheet 306. Then, interlocked with the recording on the recording sheet 306 by use of the liquid discharge head 100, the recording sheet 306 is being expelled outside the liquid discharge apparatus by means of the sheet feed roller 307 and sheet expelling roller 308 which are rotated by use of a motor, and the paper pressure plate 309 as well.

In this respect, the present invention demonstrates excellent effects particularly on a liquid discharge head of the type that creates the change of states of ink by the application of the aforesaid thermal energy with the provision of means for generating the thermal energy which is utilized for discharging liquid, among those using the ink jet recording method, as well as on the liquid discharge apparatus that uses such liquid discharge head. With the method of the kind, it becomes possible to attain recording in high density and high precision.

For the typical structure and operational principle of such method, it is preferable to adopt those implemental by the application of the fundamental principle disclosed in the specifications of U.S. Pat. Nos. 4,723,129 and 4,740,796, for example. This method is applicable to the so-called on-demand type recording and a continuous type recording as well. Here, in particular, with the application of at least one driving signal that corresponds to recording information, the on-demand type provides an abrupt temperature rise beyond nuclear boiling by each of the electrothermal converting elements (for the present invention, the discharge energy generating devices 3) arranged corresponding to a sheet or a liquid path where liquid (ink liquid or the like) is retained. Then, thermal energy is generated by each of the electrothermal converting elements, hence creating film boiling on the thermal activation surface of recording head to effectively form resultant bubbles in liquid one to one corresponding to each of the driving signals. Then, by the growth and shrinkage of each bubble, liquid is discharged through each of the discharge openings, hence forming at least one droplet. The driving signal is more preferably in the form of pulses because the growth and shrinkage of each bubble can be made instantaneously and appropriately so as to attain the performance of excellent discharges of liquid, in particular, in terms of the response action thereof. The driving signal given in the form of pulses is preferably such as disclosed in the specifications of U.S. Pat. Nos. 4,463,359 and 4,345,262. In this respect, the temperature increasing rate of the thermoactive surface is preferably such as disclosed in the specification of U.S. Pat. No. 4,313,124 for the excellent recording in a better condition.

What is claimed is:

1. A liquid discharge head comprising:

a discharging energy generating device for generating energy to be utilized for discharging liquid as a drop; and a discharge port arranged to face said discharging energy generating device, wherein an area of said discharge port is smaller than an area of said discharging energy generating device, and said discharge port is arranged in said liquid, and a distance from the front edge of said discharge port to an interface for liquid and the air outside to be in contact is within a range of 2 $\mu$m to 20 $\mu$m in a state that said discharging energy generating device is not driven.

2. A liquid discharge head according to claim 1, wherein an opening portion forming the interface for liquid and the air outside to be in contact is provided to face said discharge port, and the area of the opening portion is larger than the area of said discharge port.

3. A liquid discharge head according to claim 2, wherein one opening portion is arranged for a plurality of discharge ports.

4. A liquid discharge head according to claim 1, wherein corresponding to said discharging energy generating device, a liquid flow path is arranged for supplying liquid onto said discharging energy generating device.

5. A liquid discharge head according to claim 1, wherein a discharge port formation wall surrounds a space from the surface of said discharging energy generating device to said discharge port.

6. A liquid discharge head according to claim 5, wherein corresponding to said discharging energy generating device, a liquid flow path is arranged for supplying liquid onto said discharging energy generating device.

7. A liquid discharge head according to claim 6, wherein an opening portion forming the interface for liquid and the air outside to be in contact is arranged in a position facing said discharge port.

8. A liquid discharge head according to claim 7, wherein the area of said opening portion is larger than the area surrounded by the edge portion of the outer wall of said discharge port formation wall on said discharge port side.

9. A liquid discharge head according to claim 6, wherein the height of said discharge port formation wall and the height of a liquid flow path wall for forming said liquid flow path are the same.

10. A liquid discharge head according to claim 1, wherein said liquid discharge head discharges liquid as a drop by creating film boiling in liquid by thermal energy generated by said discharging energy generating device.

11. A liquid discharge apparatus having mounted a liquid discharge head according to claim 1 for discharging liquid as a drop from said liquid discharge head for adhesion thereof to a recording medium, comprising:

carrying means for conveying said recording medium.

12. A liquid discharge head comprising:

a discharging energy generating device for generating energy to be utilized to discharge liquid as a droplet;

a bubble discharging chamber provided with said discharging energy generating device; and a discharge port for discharging liquid filled in said bubble discharging chamber to outside said bubble discharging chamber, said discharge port arranged to face said discharging energy generating device and continued to said bubble discharging chamber, wherein the area of said discharge port is smaller than the area of said bubble discharging energy generating device, said bubble discharging chamber and said discharge port are provided in liquid, and a distance from the front edge of said discharge port to an interface for liquid and the air outside to be in contact is within a range of 2 $\mu$m to 20 $\mu$m in a state that said discharging energy generating device is not driven.

13. A liquid discharge head comprising:

an opening portion forming an interface for liquid and air outside to be in contact for discharging liquid as a drop; and a bubble discharging chamber provided with a discharging energy generating device for generating energy to be utilized to discharge liquid and a discharge port, for discharging liquid filled in said bubble discharging chamber to outside said bubble discharging chamber, wherein the area of said discharge port is smaller than the area of said discharging energy generating device, and said opening portion is provided so that said discharge chamber is provided in the liquid and a distance from the front edge of said bubble discharging chamber to the interface for liquid and air outside to be in contact is within a range of 2 $\mu$m to 20 $\mu$m in a state that said discharging energy generating device is not driven.

14. A liquid discharge head comprising:

an opening portion forming an interface for liquid and air outside to be in contact for discharging liquid as a drop; and a bubble discharging chamber provided with a discharging energy generating device for generating energy to be utilized to discharge liquid and a discharge port provided as the smallest part of said bubble discharging chamber, said discharge port facing said discharging energy generating device, wherein said opening portion is provided so that said bubble discharging chamber is provided in the liquid and a distance from the front edge of said bubble discharging chamber to the interface for liquid and the air outside to be in contact is within a range of 2 $\mu$m to 20 $\mu$m in a state that said discharging energy generating device is not driven.

15. A liquid discharge head comprising:

an opening portion forming an interface for liquid and air outside to be in contact for discharging liquid as a drop; and a bubble discharging chamber provided with a discharging energy generating device on a substrate for generating energy to be utilized to discharge liquid and a discharge port provided at an opposite side to said substrate for discharging liquid filled in said bubble discharging chamber to outside said bubble discharging chamber, wherein said opening portion is provided so that said bubble discharging chamber is provided in the liquid and a distance from the front edge of said bubble discharging chamber to the interface for liquid and the air outside to be in contact is within a range of 2 $\mu$m to 20 $\mu$m in a state that said discharging energy generating device is not driven.

16. A liquid discharge head comprising:

an opening portion forming an interface for liquid and air outside to be in contact for discharging liquid as a drop; and a bubble discharging chamber provided with a discharging energy generating device on a substrate for generating energy to be utilized to discharge liquid and a discharge port provided at an opposite side to said substrate for discharging liquid filled in said bubble discharging chamber to outside said bubble discharging chamber, wherein said opening portion is provided so that said bubble discharging chamber is provided in the liquid and a distance from the front edge of said bubble discharging chamber to the interface for liquid and the air outside to be in contact is within a range of 2 $\mu$m to 20 $\mu$m in a state that said discharging energy generating device is not driven; and a center of said discharge port is offset from a center of said discharging energy generating device.

17. A liquid discharge method for a liquid discharge head provided with:

an opening portion forming an interface for liquid and air outside to be in contact for discharging liquid as a drop; and a bubble discharging chamber provided with a discharging energy generating device for generating energy to be utilized to discharge liquid and a discharge port for discharging liquid filled in said bubble discharging chamber to outside said bubble discharging chamber, wherein the area of said discharge port is smaller than the area of said discharging energy generating device, said method comprising the steps of:

driving said discharging energy generating device when said discharge chamber is provided in the liquid and a distance from the front edge of said bubble discharging chamber to the interface for liquid and the air outside to be in contact is within a range of 2 $\mu$m to 20 $\mu$m; and discharging liquid as a drop from said opening portion to the outside.

18. A liquid discharging method for a liquid discharge head provided with:

an opening portion forming an interface for liquid and air outside to be in contact for discharging liquid as a drop; and a bubble discharging chamber provided with a bubble generating device for generating a bubble by heating liquid to be utilized to discharge liquid and a discharge port for discharging liquid held in said bubble discharging chamber to outside said bubble discharging chamber, wherein the area of said discharge port is smaller than the area of said bubble generating device, said method comprising the steps of:

driving said bubble generating device when said discharge chamber is provided in the liquid and a distance from the front edge of said bubble discharging chamber to the interface for liquid and the air outside to be in contact is within a range of 2 $\mu$m to 20 $\mu$m;

supplying liquid to said bubble discharging chamber fully by vanishing of the bubble.

* * * * *

UNITED STATES PATENT AND TRADEMARK OFFICE

CERTIFICATE OF CORRECTION

PATENT NO. : 6,588,887 B2
DATED : July 8, 2003
INVENTOR(S) : Masahiko Ogawa

It is certified that error appears in the above-identified patent and that said Letters Patent is hereby corrected as shown below:

Column 3,
Line 56, “whack” should read -- which --.

Column 6,
Line 26, “easy” should read -- ease --; and
Line 65, “depends” should read -- depending --.

Column 16,
Line 63, “20 $\mu$m;” should read -- 20 $\mu$m; and --.

Signed and Sealed this

Thirtieth Day of December, 2003

JAMES E. ROGAN
*Director of the United States Patent and Trademark Office*